US005196764A

United States Patent [19]

Kim et al.

[11] Patent Number: 5,196,764

[45] Date of Patent: Mar. 23, 1993

[54] CATHODE RAY TUBE HAVING SYMMETRICAL ANODE POTENTIAL

[75] Inventors: Dukryong Kim, Incheon; Kyungwon Kim, Suwon, both of Rep. of Korea

[73] Assignee: Samsung Electron Devices Co., Ltd., Kyunggi-do, Rep. of Korea

[21] Appl. No.: 726,955

[22] Filed: Jul. 8, 1991

[30] Foreign Application Priority Data

Dec. 27, 1990 [KR] Rep. of Korea ..... 90-22558

[51] Int. Cl.[5] ..... H01J 29/88; H01J 29/92

[52] U.S. Cl. ..... 313/477 HC; 313/479

[58] Field of Search ..... 313/477 HC, 479, 477

[56] References Cited

U.S. PATENT DOCUMENTS 3,959,686 5/1976 Davis et al. ..... 313/479 X
3,996,491 12/1976 Larson et al. ..... 313/479
4,450,387 5/1984 Reed et al. ..... 313/479 X
4,528,477 7/1985 Gallaro ..... 313/479
4,638,212 1/1987 Deal et al. ..... 313/479
4,933,598 6/1990 Sudo et al. ..... 313/477 HC

FOREIGN PATENT DOCUMENTS 0137268 10/1979 Japan ..... 313/479
0061749 5/1981 Japan ..... 313/479

*Primary Examiner*—Palmer C. DeMeo
*Attorney, Agent, or Firm*—Christie, Parker & Hale

[57] ABSTRACT

A CRT wherein a pair of anode buttons are fixed in a symmetrical position on the outer surface of a funnel of the CRT and led through the funnel, to contact an inner conductive coating, thereby forming relatively symmetrical anode potential.

4 Claims, 6 Drawing Sheets

Luminance
Landing & Strip Width
18.8 (53.7)
29.6 (84.6)
18.9 (54)
35.0 (100)
17.6 (50.3)
23.8 (68)
16.3 (46.6)
32
< < <

Luminance

CATHODE RAY TUBE HAVING SYMMETRICAL ANODE POTENTIAL

BACKGROUND OF THE INVENTION

The present invention relates to a cathode ray tube (hereafter referred to as CRT), and in particular to a CRT having symmetrical anode potential for improving uneven luminance on its screen.

FIG. 1 illustrates a conventional CRT for a color picture as in the U.S. Pat. Nos. 4,528,477 and 4,638,213.

The CRT 10 comprises a faceplate panel 14 on whose inner surface fluorescent material 12 is deposited, a neck 16 positioned opposite the panel 14, a funnel 18 to form a bulb by connecting integrally the faceplate panel 14 with the neck 16, and an electron gun mounted in the neck 16.

The electron gun is of a conventional bipotential type, including a cathode 22 having a heater 20, a plate type control electrode 24, a cup type screen electrode 26, a focus electrode 28, and a high-voltage electrode 30 to which anode voltage is supplied.

An anode button 32 or receptacle is fixed on the outer surface of the funnel 18 and led through the funnel 18 and electrically connected to a conductive coating 34 on the inner surface of the funnel 18.

FIG. 2 illustrates a conventional envelope structure of the anode button 32 mounted on the funnel 18. Button 32 is in electrical contact with coating 34 via metal strip 36 on the inner face of the funnel 18.

The conductive coating 34 is deposited by colloid-type graphite to the extent of electrically contacting the fluorescent material 12 as shown in FIG. 1, a shadow mask 38 adjacent to the fluorescent material, and snubbers 40 which provides an electrical path to the high-voltage electrode 30 of the gun from the conductive coating 34. The strips may also function to dampen vibrations.

Electrodes from the gun are respectively supplied from each of stem leads 42 which extend out the stem of the neck 16. Examples of the supplied voltage are as follows:

cathode ; 200–400 V
control electrode ; 0–1 KV
screen electrode ; 0–1 KV
focus electrode ; 1–10 KV
high-voltage electrode ; 5–35 KV, wherein the voltage supplied to the high-voltage electrode is the same as the anode voltage.

Thermions emitted from the cathode 22 due to the heater 20 are changed into electron beams through the control electrode 24, screen electrode 26, focus electrode 28, and high-voltage electrode 30. The electron beams then land on the fluorescent material 12, to thereby form a picture.

This picture, as it appears on the faceplate panel, will have sectional differences in luminance.

FIGS. 3 (A) and (B) show the measured examples with regard to the luminance dispersed on the screen of two randomly-selected 29" color CRTs having conventional structure. In the drawings of luminance, the numerals are luminance values with its unit of lux, and the numerals in parentheses are comparative values of surrounded portions with taking the central luminance value of the screen as 100.

In the drawings of landing & strip width, the numerals are strip width values of a fluorescent pattern with its unit of lux, and the A, B, C, and D are grades of mis-landing in surrounded portions compared with the landing condition of central portion as a standard.

As shown in the figures, the luminance dispersion of peripheral portions which are in a symmetrical position with each other is especially uneven.

The luminance of a CRT depends on the material quality and the deposited condition of fluorescent pattern, the voltage dispersion in the CRT, the strip width, and the landing condition of electron beams.

If any fluorescent pattern has the same depositing condition, the voltage dispersion, the strip width, and the landing condition of electron beams are factors having a great effect on the luminance of CRT.

The measured result of the landing condition and stripe width in the CRT does not include any factors which cause the uneven luminance. Accordingly, the subject cause of the uneven luminance on the CRT screen is posited to be voltage dispersion. However since the inner voltage dispersion of CRT is in fact impossible to be measured, there is no direct method of proof.

It is only given that, if the measured luminance of a CRT is charted according to each portion of the screen, the portion to which the anode button 32 is fixed has a higher luminance value than a symmetrically disposed portion, e.g., with respect to a horizontal, vertical or diagonal axis. This gives indirect evidence that the inner voltage dispersion of the CRT has strong effects on luminance.

That is, the conductive coating 34 adjacent to the anode button 32 has denser potential than the conductive coating 34 in the symmetrical position remote from the anode button 32, whereby unevenness of the voltage dispersion occurs and thus effects the luminance.

Such a supposition is evidently supported by the data which is gained from measuring the terrestrial magnetic field effect of the CRT.

FIG. 4 (A) shows the respective varying amount of electron beams according to horizontal magnetic field variations measured at each screen part in the respective cases of directing the CRT in FIG. 3 (A) to east, west, south, or north, changing the direction of the CRT into the west after degaussing it in the east, and changing the direction of the CRT into the south after degaussing it in the north. And, the illustrations of the right side show the differences of varying amount of beams.

According to the result of the measurement, the unevenness appears in the peripheral portions which are symmetrical with each other. Such a state is found in the varying amount of beams according to vertical magnetic field variations due to the terrestrial magnetic field as shown in FIG. 4 (B). These may result from much more effect of the terrestrial magnetic field on the peripheral portions of the anode button 32 because of higher charge density of peripheral portions than that of its symmetrical portion.

OBJECTS OF THE INVENTION

The present invention provides a CRT wherein the inner conductive coating has even anode potential to prevent the unevenness of luminance in the screen, and on the CRT's outer surface, a pair of anode buttons are fixed to prevent uneven voltage dispersion of the inner conductive coating.

In a preferred embodiment, the present invention provides a CRT having symmetrical anode potential wherein the CRT includes a faceplate panel whose inner surface is deposited by fluorescent material, a neck positioned opposite to the panel, a funnel forming a bulb by connecting integrally the faceplate panel with the neck, and an electron gun mounted in the neck, and wherein the funnel has a conductive coating in its inner portion to form an electric path for supplying anode voltage and, on the outer surface of the funnel, a pair of anode buttons are fixed in a symmetrical position with each other, thereby to contact with the inner conductive coating through the funnel.

DESCRIPTION OF THE PREFERRED EMBODIMENT

Figure 1:
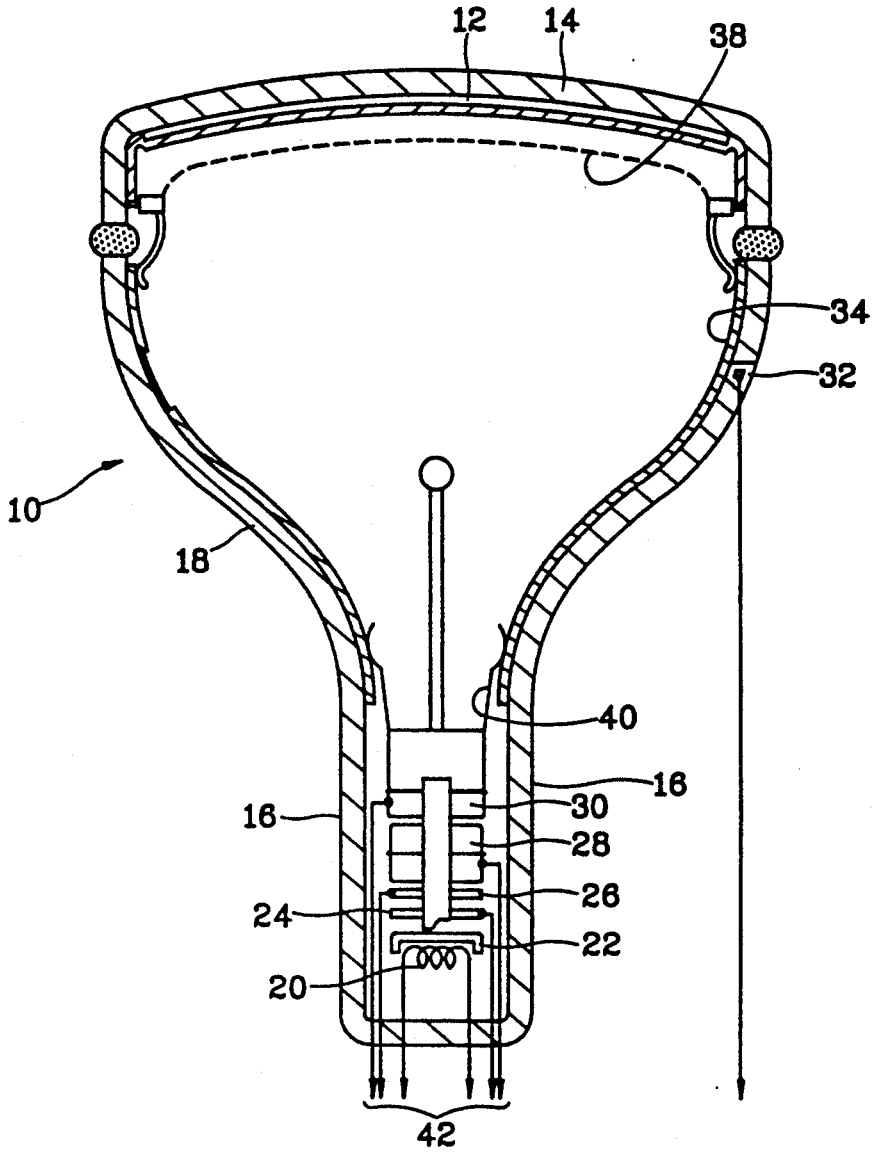
FIG. 1 (Prior Art)
FIG. 1 is a schematic sectional view of a typical construction of the conventional CRT.
Figure 2:
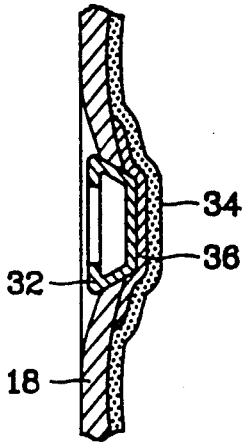
FIG. 2 (Prior Art)
FIG. 2 is a sectional view of the anode button illustrated in FIG. 1.
Figure 3A:
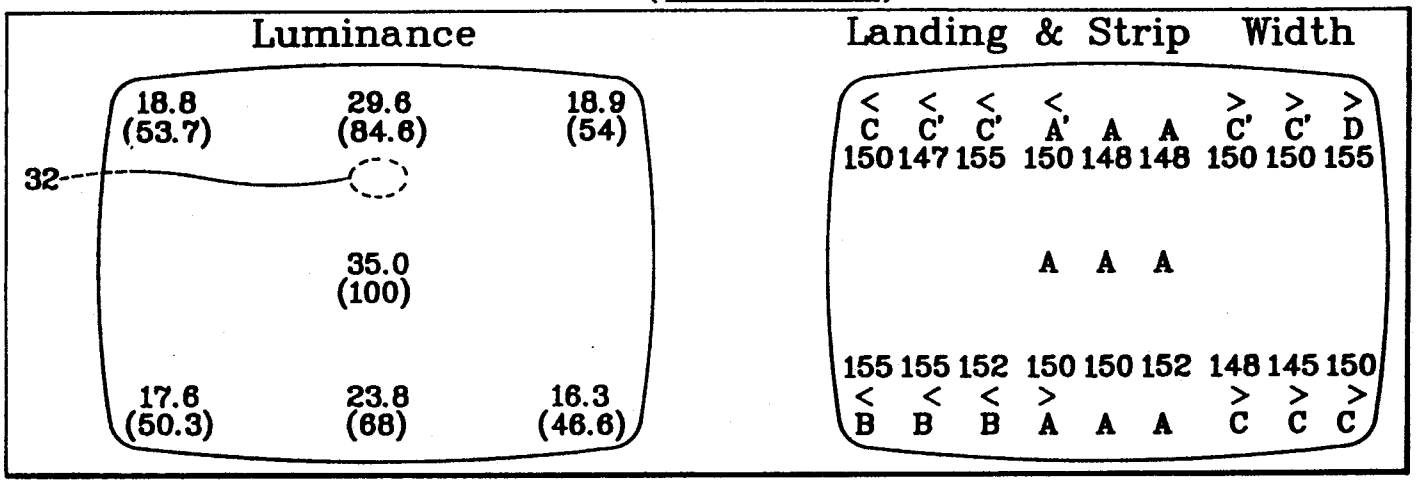
FIG. 3A (Prior Art)
FIGS. 3 (A) and 3 (B) are respective illustrations of luminance dispersion on the screen, and the landing and strip width of electron beams of randomly-selected CRTs having the same structure as in FIG. 1.
Figure 4A:
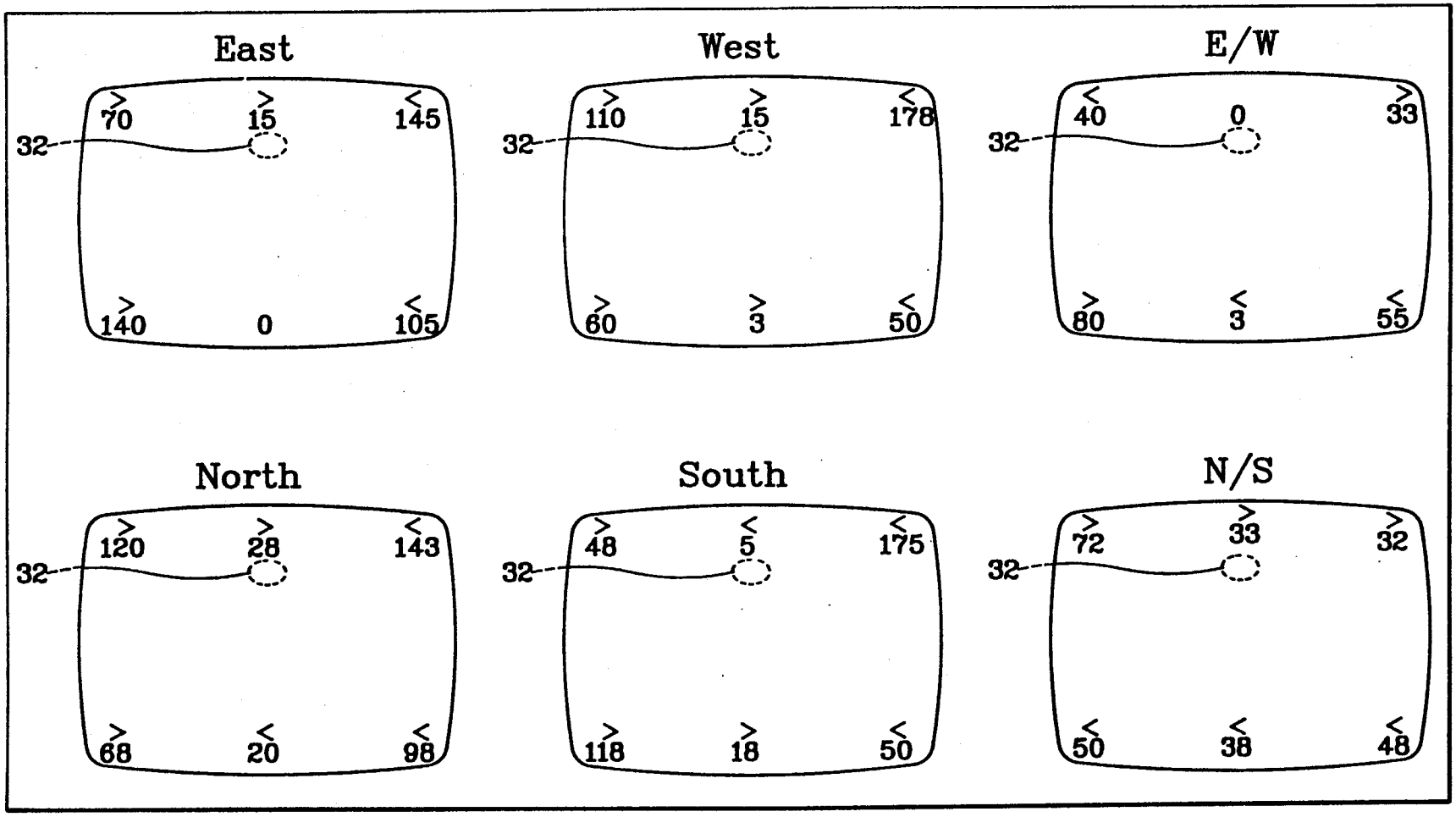
FIG. 4A (Prior Art)
FIGS. 4 (A) and 4 (B) are illustrations of the varying amount of electron beams according to the change of horizontal and vertical magnetic fields from the terrestrial magnetic field relating to the CRTs in FIG. 3 (A) and (B).
Figure 4B:
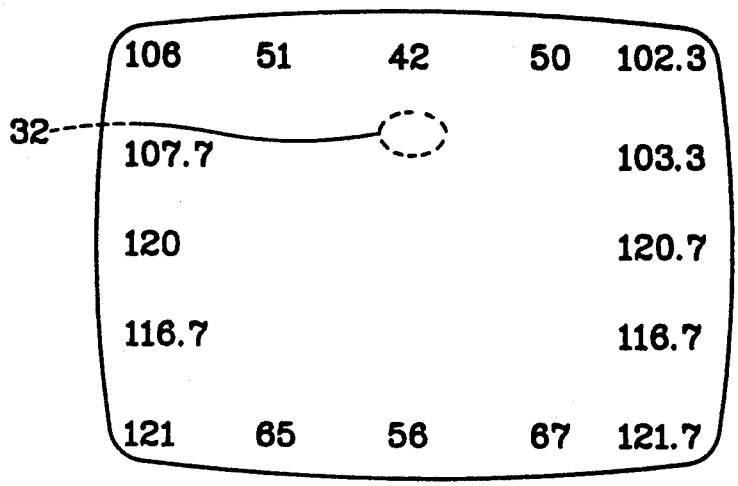
FIG. 4B (Prior Art)
Figure 6:
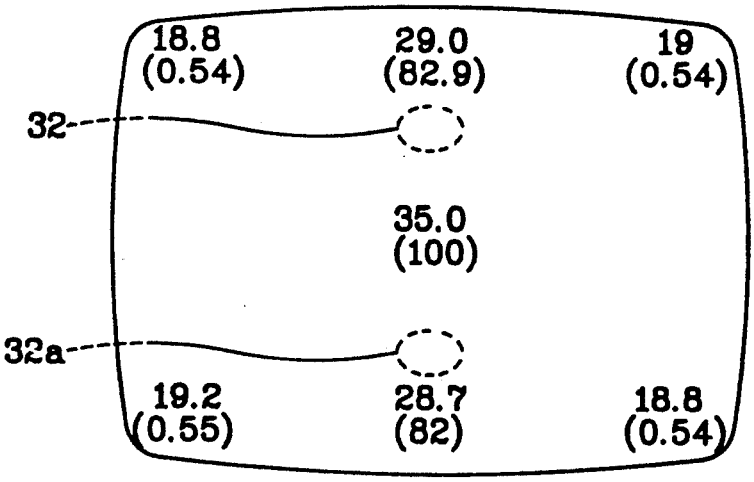
FIG. 6 is an illustration showing the luminance dispersion in a screen of the CRT of FIG. 5.
Figure 5:
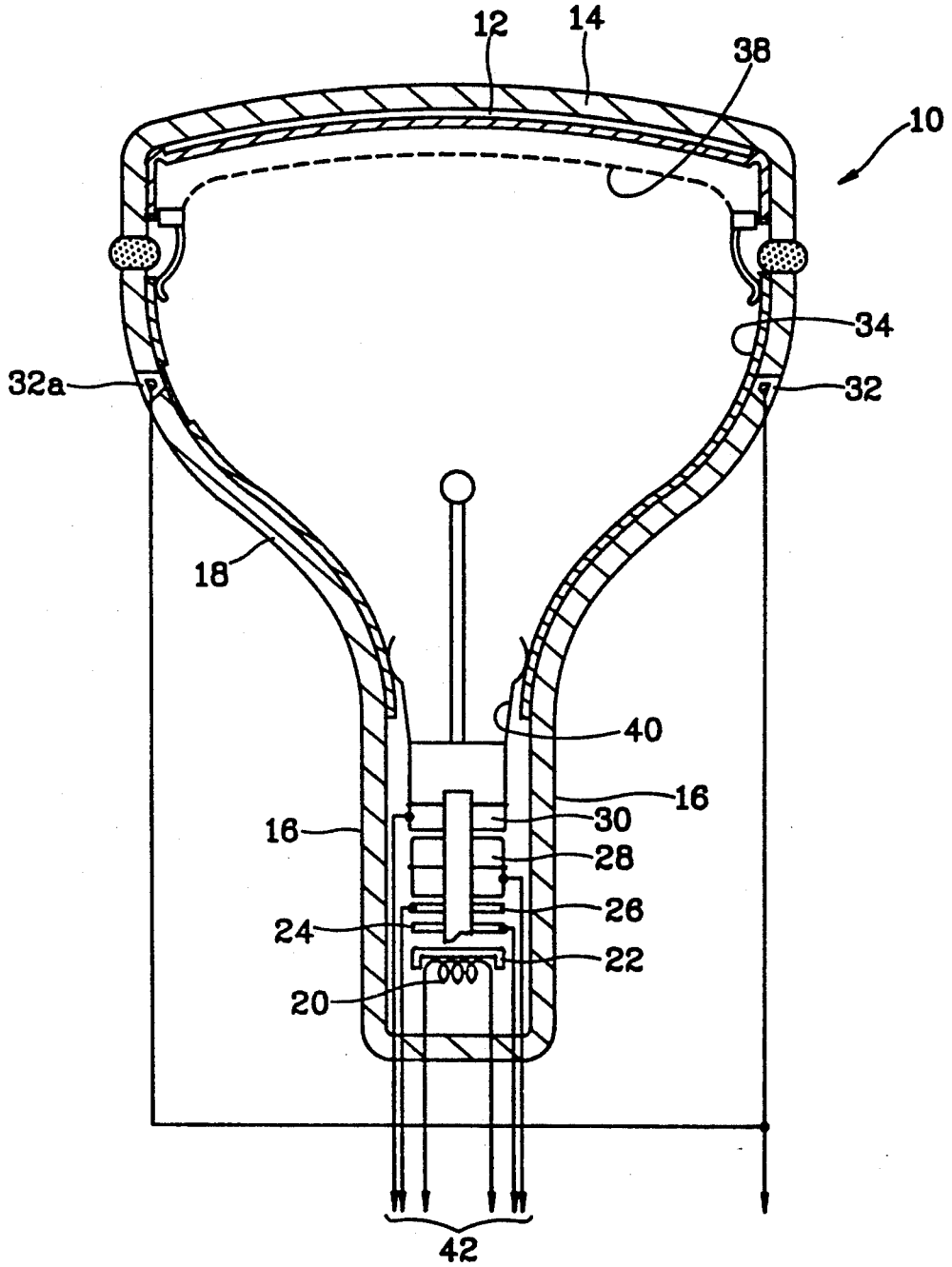
FIG. 5 is a schematic sectional view of a CRT according to the present invention.
Figure 7:
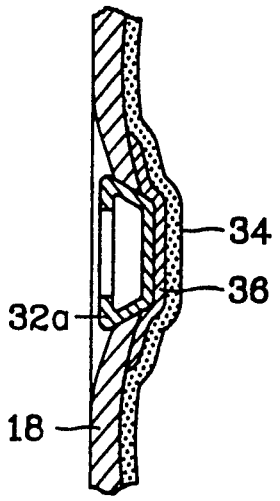
FIG. 7 is a sectional view of a second anode button in the CRT of FIG. 5.

A CRT 10 in FIG. 5 comprises a faceplate panel 14 on whose inner surface fluorescent material is deposited, a neck 16 positioned opposite to the panel 14, a funnel 18 forming a bulb by connecting integrally the faceplate panel 14 with the neck 16, and an electron gun mounted in the neck 16.

In the CRT 10, the electron gun is of bipotential type including a cathode 22 having a heater 20, a control electrode 24, a screen electrode 26, a focus electrode 28, and a high-voltage electrode 30 to which anode voltage is supplied.

On the outer surface of the funnel 18, a pair of anode contacts or buttons 32 and 32*a* are fixed in a symmetrical position with respect to each other and each one is in electrical contact with the conductive coating 34 of the inner surface.

If the buttons 32 and 32*a* are fixed in a symmetrical position with respect to each other, they can be positioned anywhere on the outer surface of the funnel 18. Accordingly, the conductive coating 34 has two paths of supplied voltage, by way of the pair of anode buttons 32 and 32*a* fixed in a symmetrical position with respect to each other, through the periphery of the funnel 18.

The conductive coating 34 is deposited by colloid type graphite to the extent of electrically contacting the fluorescent material 12, a shadow mask 38 adjacent thereto, and metal-strips 40 in order to provide an electrical path to the high-voltage electrode 30 of the electron gun from the conductive coating 34.

Electrodes from the electron gun are respectively supplied with certain voltages from each of stem leads 42 which extends through the stem of the neck 16. The supplied voltages are as follows:

cathode ; 200–400 V
control electrode ; 0–1 KV
screen electrode ; 0–1 KV
focus electrode ; 1–10 KV
high-voltage electrode ; 5–35 KV, wherein the voltage supplied to the high voltage electrode is the same as anode voltage.

Thermions emitted from the cathode 22 by the operation of the heater 20 are changed into electron beams through the control electrode 24, screen electrode 26, focus electrode 28, and high-voltage electrode 30. The electron beams land on the fluorescent material 12, to thereby form a picture.

During this process, the conductive coating 34 is supplied with high potential anode voltage through the pair of anode buttons 32 and 32*a*, so that the voltage dispersion caused by potential in the conductive coating 34 is symmetrical about an axis which is the pair of anode buttons 32 and 32*a*.

As the voltage dispersion of the conductive coating 34 becomes symmetrical and as it has an effect on the luminance dispersion on the screen,the luminance dispersion as measured at the upper and lower sides of peripheral screen portions is relatively even.

Consequently, the present invention vastly improves the picture quality by equalizing lower luminance dispersion of peripheral screen portions with that of central portions.

What is claimed is:

1. A CRT having a faceplate panel whose inner surface comprises a fluorescent material, a neck positioned opposite to the panel, a funnel having an interior portion and forming a bulb by connecting integrally the faceplate panel with the neck, and an electron gun mounted in the neck, wherein the funnel has a conductive coating on its interior portion to form an electrical path for supplying anode voltage to its inner portion, and the CRT further comprises a pair of anode buttons fixed in a symmetrical position with respect to each other on a periphery of the funnel, to thereby contact the conductive coating through the funnel, and means for commonly electrically connecting the anode buttons.

2. A CRT comprising:

a display panel having an inner surface and outer display surface;

a neck disposed opposite the display panel;

a funnel connecting the neck and display panel, the funnel having an inner surface comprising a conductive path for anode voltage;

means disposed in the neck for emitting electron beams against the inner surface of the display panel to display a picture on the outer surface of the panel; and a pair of anode contacts mounted symmetrically with respect to each other in the funnel and in electrical communication with the conductive path for creating a symmetrical anode potential.

3. The CRT as claimed in claim 2, further comprising means for commonly electrically connecting the anode contacts.

4. The CRT as claimed in claim 2 wherein the conductive path comprises a conductive material coating.

* * * * *